US009775765B2

(12) United States Patent
Grigoreva

(10) Patent No.: US 9,775,765 B2
(45) Date of Patent: Oct. 3, 2017

(54) METHOD OF PASSIVE MECHANOTHERAPY AND EXERCISE MACHINE FOR IMPLEMENTATION THEREOF

(76) Inventor: Larisa Semenovna Grigoreva, Moscow (RU)

( * ) Notice: Subject to any disclaimer, the term of this patent is extended or adjusted under 35 U.S.C. 154(b) by 445 days.

(21) Appl. No.: 12/998,911

(22) PCT Filed: Apr. 29, 2010

(86) PCT No.: PCT/RU2010/000211
§ 371 (c)(1),
(2), (4) Date: Jun. 15, 2011

(87) PCT Pub. No.: WO2010/126398
PCT Pub. Date: Nov. 4, 2010

(65) Prior Publication Data

US 2012/0136283 A1 May 31, 2012

(30) Foreign Application Priority Data

Apr. 30, 2009 (RU) ..... 2009116427

(51) Int. Cl.
*A61H 1/02* (2006.01)
*A61H 1/00* (2006.01)

(52) U.S. Cl.
CPC ..... *A61H 1/0292* (2013.01); *A61H 1/02* (2013.01); *A61H 1/008* (2013.01);
(Continued)

(58) Field of Classification Search
CPC ..... A61H 1/02; A61H 1/0214; A61H 1/0292; A61H 1/008; A61H 1/0237;
(Continued)

(56) References Cited

U.S. PATENT DOCUMENTS 1,375,652 A * 4/1921 Carlotti ..... 601/97
1,643,793 A * 9/1927 Sparhawk ..... A61G 7/0573 5/610

(Continued)

FOREIGN PATENT DOCUMENTS

RU 1806712 4/1993
RU 2076677 4/1997

(Continued)

OTHER PUBLICATIONS

ISR from PCT/RU2010/000211, filed Apr. 29, 2010, dated Sep. 16, 2010.

(Continued)

*Primary Examiner* — Justine Yu
*Assistant Examiner* — Kathrynn Lyddane
(74) *Attorney, Agent, or Firm* — Duane Morris LLP

(57) ABSTRACT

The proposed method is intended for rhythmic stimulation of neurotrophic reflexes to simultaneous stretching of muscles in various sections of spine, joints of limbs and in the main muscles of a human body. The aforesaid method can be implemented by employing an exercise machine that provides for mechanical anti-phase oscillations of lodgments affecting various sections of the body and limbs without considerable movements of the neck-and-head lodgment in the vertical direction. The upper body and the lower limbs make in-phase reciprocal movements, while the pelvic area makes movements anti-phase relative thereto. A support for the neck-and-head part is installed to allow supporting natural movements of the head in the course of the aforesaid movements of the upper body. The design of the exercise machine is described in detail herein.

9 Claims, 6 Drawing Sheets

(52) U.S. Cl.
CPC ..... *A61H 2201/0142* (2013.01); *A61H 2201/5002* (2013.01); *A61H 2201/5035* (2013.01)

(58) Field of Classification Search
CPC .... A61H 2201/0192; A61H 2201/0142; A61H 2201/0146; A61H 2201/0138
USPC ..... 601/5, 23, 24, 26, 49, 97–103, 107–108; 606/237, 240
See application file for complete search history.

(56) References Cited

U.S. PATENT DOCUMENTS

| | | | | |
|---|---|---|---|---|
| 2,152,431 | A * | 3/1939 | Jensen | 606/245 |
| 2,475,003 | A * | 7/1949 | Black | A61G 13/009 5/613 |
| 3,298,363 | A * | 1/1967 | Parkin | 601/103 |
| 3,766,912 | A * | 10/1973 | Daniels | 606/242 |
| 4,483,327 | A | 11/1984 | Graham et al. | |
| 4,858,599 | A * | 8/1989 | Halpern | 601/105 |
| 4,999,861 | A * | 3/1991 | Huang | 5/600 |
| 5,171,260 | A | 12/1992 | McIlwain | |
| 5,282,835 | A | 2/1994 | Wright et al. | |
| 5,301,661 | A | 4/1994 | Lloyd | |
| 5,320,641 | A | 6/1994 | Riddle et al. | |
| 5,468,216 | A | 11/1995 | Johnson et al. | |
| 5,505,691 | A * | 4/1996 | Fenkell | 601/99 |
| 5,520,614 | A * | 5/1996 | McNamara et al. | 601/24 |
| 6,319,213 | B1 | 11/2001 | Tomac | |
| 6,681,770 | B1 * | 1/2004 | Dreher | 128/845 |
| 6,821,288 | B2 * | 11/2004 | Schaeffer | 606/240 |
| 7,338,459 | B2 * | 3/2008 | Swidler | A61H 1/001 601/100 |
| 7,572,239 | B1 * | 8/2009 | Brotz | 601/98 |
| 7,587,770 | B1 * | 9/2009 | Reser et al. | 5/613 |
| 2004/0002668 | A1 * | 1/2004 | Mahan | 601/86 |
| 2004/0082970 | A1 * | 4/2004 | Harris et al. | 606/242 |

FOREIGN PATENT DOCUMENTS

| | | |
|---|---|---|
| SU | 194258 | 1/1967 |
| SU | 1041112 | 9/1983 |

OTHER PUBLICATIONS

Booth F. W., Effect of Limb Immobilization on Skeletal Muscle; Journal of Applied Physiology, May 1, 1982, vol. 52, No. 5, pp. 1113-1118.

Grigoreva, L. S., in: Proc. of V International Conference "Modern Technologies of Restorative medicine," Healing Effect of the New Kinesitherapy Method on Certain Basic Indices of Health, 2002, p. 165, Sochi, Russia.

Grigoreva, L. S., in Proc. of the International Congress "Tropical Issues of Restorative Medicine, Spa Medicine and Physiotherapy," Employing the Principle of Dynamical Stretching of Relaxed Muscles in Corrections of Certain Basic Indices of Health, 2006, p. 88, Sochi, Russia.

Grigoreva, L. S., in: Proc. of the X International Conference "Career Longevity and Quality of Life," Movement Therapy as a factor of Adaptive Correction, 2007, p. 240, Moscow, Russia.

* cited by examiner

METHOD OF PASSIVE MECHANOTHERAPY AND EXERCISE MACHINE FOR IMPLEMENTATION THEREOF

CROSS-REFERENCE TO RELATED APPLICATIONS

This application is a U.S. national phase application of a PCT application PCT/RU2010/000211 filed on 29 Apr. 2010, published as WO2010/126398, whose disclosure is incorporated herein in its entirety by reference, which PCT application claims priority of a Russian Federation patent application RU2009/116427 filed on 30 Apr. 2009.

FIELD OF THE INVENTION

The invention relates to medicine and physical training and sports, and may be used for curative, restorative, and wellness purposes.

BACKGROUND OF THE INVENTION

Mechanotherapy is known to be efficient means of curative and restorative effect on the organism of a sick and healthy person, and holds a special place in the concept of kinesophilia and the theory of viscero-motor reflexes. Mechanotherapy may promote restoration of muscular tonus, motion of joints, muscular strength, motor functions, and other rehabilitation effects. Here, passive mechanotherapy, i.e., the one exercised without the patient's active muscular efforts, reduces the number of medical contraindications to using physical exercise. Passive stretching of muscles causes reflex currents producing a beneficial effect on the neuromuscular regulation systems, and hence, on regeneration and restoration processes.

Various implementations of passive mechanotherapy are known. For example, in invention (RU2076677, Grigoreva, Apr. 10, 1997), a method of physical exercises is described, where the patient is positioned in a lying or reclining posture on the surface of a support, causing rhythmic stretching of relaxed muscles performed through displacement of mobile links of the support. The rhythmic stretching of relaxed muscles is exercised at a frequency of 0.1-10 Hz, with the support positioned at 5-10° to the horizontal. However, in this method, no modes or devices are disclosed actuating the aforesaid effect; neither a possibility is specified of producing a local effect on parts of spine, knee and ankle joints.

There are known methods of mechanotherapy (U.S. Pat. No. 4,483,327, Graham, Lloyd, Nov. 20, 1984; U.S. Pat. No. 5,301,661, Lloyd, Apr. 12, 1994) by means of moving the body up and down along a circular trajectory in a plane perpendicular to the bed centerline and the longitudinal axis of the body, which ensures the relaxing effect. However, this method of mechanotherapy does not ensure stimulation of neurotrophic reflexes to muscle stretching, as it creates no considerable dislocation in joints.

There are known methods of mechanotherapy with implementation of passive stoop-and-stretch of the body by means of an exercise machine comprising hinged lodgments mounted in cantilever for the upper and the lower parts of the body, which are set in oscillatory motion opposite to the motion of the medium lumbar lodgment (U.S. Pat. No. 2,152,431, Jensen, Mar. 28, 1939; U.S. Pat. No. 5,282,835, Wright et al., Feb. 1, 1994; U.S. Pat. No. 6,319,213, Tomas, Nov. 20, 2001). Oscillations of lodgments at various angles to the horizontal may be exercised in both the in-phase and anti-phase (U.S. Pat. No. 5,320,641, Riddle et al., Jun. 14, 1994) modes, and are implemented by the drive operating mode. These methods of mechanotherapy fail to provide for any relative movement of various parts of spine and the lower limbs, which rules out stretching of the main superficial and deep skeletal muscles. There is a known method of rehabilitation based on using passive flexural motions of the body (U.S. Pat. No. 5,171,260, McIlwain, Dec. 15, 1992). Cyclic movements of the body and legs are provided for the purpose of stimulation of blood circulation and muscular tonus for enhancing the restorative process in the loin area. Rehabilitation comprises positioning of the patient on a support made up of three parts—the central stationary part, where the lumbar section is fixed, and two movable ones, for the upper and the lower parts of the body. The movable parts are cyclically displaced in the vertical plane by an angle of 20 . . . 25° at a frequency of 4 to 15 oscillations per minute, which ensures synchronous bending of the body relative to the lumbar area. In its essence, this method ensures stretching of the spine lumbar area; however, it provides virtually no stimulating effect on other sections of spine and other main muscles of the body, as it creates no considerable dislocation in the relevant joints.

Exercise machines for performing passive mechanotherapy comprise a base, mostly in the form of a rigid frame, and a lodgment comprising several parts attached to the frame. The inclination angles, the speed of oscillatory movement, and the exposure duration are adjusted with a control unit through variation of performance of a drive, embodied as a screw pair; the support for the cervical spine may, in the course of the body oscillations, move freely along slide rails (see, e.g., U.S. Pat. No. 5,468,216, Johnson et al., Nov. 21, 1995). However, the aforesaid passive mechanotherapy devices are rather complicated and are of a narrow targeting as they are limited to creation of alternating loads only in the distressed lumbar area to stimulate restoration of blood circulation in this area, yet they do not involve most of the skeletal muscles in the course of stretching.

The claimed inventions are based on the following assumptions and experimentally obtained results. Stretching of muscles is known to be a powerful natural factor stimulating neurotrophic functions (see, e.g., Booth F. W. Appl. Physiol.: Respirat. Environ. Exercise Physiol. 1982, 52, No. 5, p. 1113-1118). Static stretching of muscles is known to have no long-term aftereffect, although it does produce a trophic effect for some time. The author's studies (RU2076677) have shown that application of rhythmic stretching of relaxed muscles produces an efficient and rather prolonged influence on the state of the cardiovascular system, the emotional sphere, the locomotor system, as well as disorders of lipometabolism (Grigoreva, L. S., in: Proc. of V International Conference "Modern Technologies of Restorative Medicine": Healing Effect of the New Kinesitherapy Method on Certain Basic Indices of Health (in Russian): Russia, Sochi, 2002, p. 165; Grigoreva, L. S., in: Proc. of the International Congress "Topical Issues of Restorative Medicine, Spa Medicine and Physiotherapy": Employing the Principle of Dynamical Stretching of Relaxed Muscles in Corrections of Certain Basic Indices of Health: Russia, Sochi, 2006, p. 88 (in Russian); Grigoreva, L. S., in: Proc. of the X International Conference "Professional Longevity and Quality of Life" Movement Therapy as a factor of Adaptive Correction, Russia, Moscow, 2007, p. 240 (in Russian)). At the same time, the aforesaid health-improving effect was observed to be accompanied by statistically reliable effects of stabilization of the main dominant frequencies of the brain bio-potentials in the range of the alpha-rhythm related to regulation of homeostatic functions of human body. As is shown below, the same effect, from the point of view of conditions for optimization of reflexes to stretching, may be achieved in a more efficient way, through alternating exposures on various sections of the body and legs perpendicular to the body's longitudinal axis, of adjustable frequency and amplitude, with the head, or the neck, positioned on a stationary support. The latter circumstance, contrary to the prototype, produces no irritating effect on the vestibular apparatus. The distinctive features of the exercise machine also include a possibility of stoop-and-stretch in various sections of spine (namely, cervical, thoracic and lumbar ones), as well as in the lower limbs, with the movable support positioned in the area of the relevant joints.

As is shown in our studies, the invention enables a health-improving effect on the organism, which is made up of the following beneficial results. These include restoration of mobility and range of movements in various sections of spine and limbs, elimination of excessive body weight, positive effect on the cardiovascular system with correction of blood pressure and cardiac rhythm, as well as facilitation and stimulation of the transport function of blood. The latter is achieved owing to affecting the main superficial and deep muscular groups related to elastic structures of blood circulation and lymph flow, which creates additional opportunities for prevention and arresting of stagnating effects in the above systems and oxygen deprivation in tissues.

SUMMARY OF THE INVENTION

The object of this invention is improving the method of passive mechanotherapy for improvement of human health and an exercise machine for implementation thereof for the purpose of providing an enhancing effect on neurotrophic reflexes to stretching of most of skeletal muscles, motor and viscero-motor mechanisms of regulation of activities of the cardiovascular system, the condition of the locomotor system and metabolism.

The method of passive mechanotherapy consists in providing alternating loads on the musculoskeletal system of a person in rest, the above person positioned lying on a base having a support stationary relative to the base for the neck-and-head section, and a lodgment movable relative to the base for positioning of the body and the lower limbs. The alternating loads are created through reciprocal movements of specific parts of the lodgment in the vertical direction in such a way that the upper body and the lower limbs make in-phase reciprocal movements, while the pelvic section make movements anti-phase relative to them. The support for the neck-and-head section is installed to allow support for the head's natural movements in the course of the aforesaid movements of the upper body, while the dimensions and the position of specific sections of the lodgment relative to the longitudinal axis of the body are set to allow local effect on various sections of the body, spine and the lower limbs. The amplitude of reciprocal movements of the lodgment sections is limited to movements of the upper body, pelvis and legs relative to each other and to the position of the neck-and-head section, which are natural for a healthy person, with peculiarities of the person's constitution taken into account, and for a patient, with due consideration of medical indications, as well.

The exercise machine for passive mechanotherapy comprises a base, an extended lodgment for the body and the lower limbs of a person connected to a drive of reciprocal motion, and a support for the neck-and-head section. The support for the neck-and-head section is installed on the base and is isolated from the lodgment. The lodgment is implemented in such a way, which ensures vertical anti-phase movements of its medium section relative to the peripheral sections in the plane of longitudinal symmetry running through the support for the neck-and-head section. The lodgment may be implemented in the form of at least three separate movable elements connected to the drive, intended for positioning the upper body, the pelvic section and the lower limbs, and fixed to the base stationary elements positioned between them with a gap. The lodgment may constitute a panel made elastic in the direction of an axis normal to the surface, its central part made rigid across the width and connected to the drive, whereas its stationary elements attached to the base are installed to allow bending oscillations of the panel.

The inventive method provides for an unexpected result of rhythmic stimulation of neurotrophic reflexes to simultaneous stretching of muscles in most of the muscular groups of the human body, which considerably raises the efficiency of generation of natural reflex flows in response to the stretching, which are of a beneficial neurotrophic effect. The inventive method provides for anti-phase mechanical oscillations of the lodgment sections for the body and limbs, which allows various sections of the upper body and the lower limbs to be positioned thereon, with no significant movements of the neck-and-head lodgment in the vertical direction.

Figure 1A:
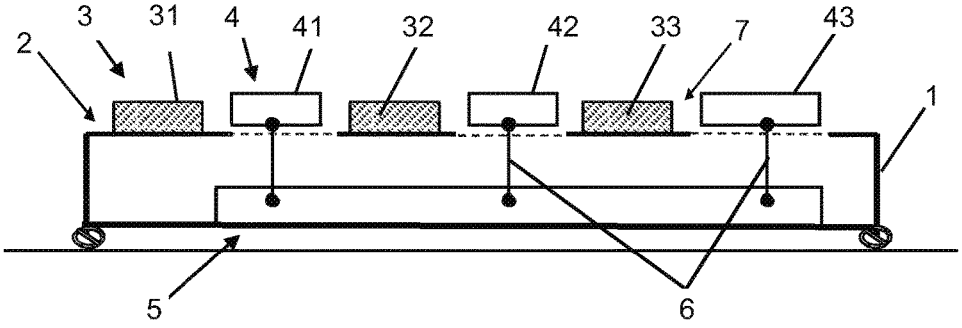
FIG. 1 presents a side schematic view of an embodiment of the inventive exercise machine with discrete movable and immovable lodgment sections.
Figure 1B:
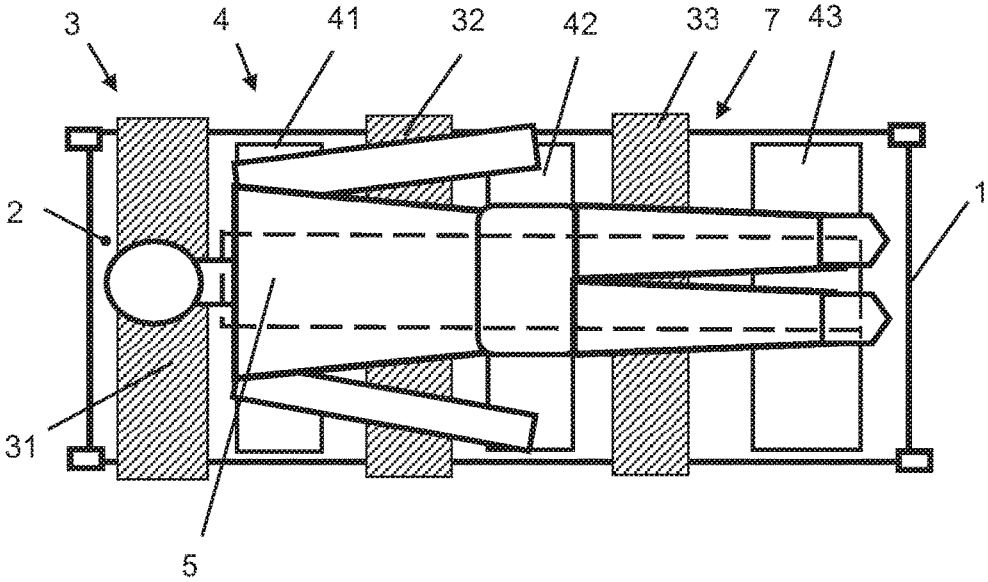

As Applicant believes, the specification amendments include no new subject matter, since they are based on the original disclosure.

DETAIL DESCRIPTION OF PREFERRED EMBODIMENTS OF THE INVENTION

While the invention may be susceptible to embodiment in different forms, there are described in detail herein below, specific embodiments of the present invention, with the understanding that the present disclosure is to be considered an exemplification of the principles of the invention, and is not intended to limit the invention to that as illustrated and described herein.

The inventive method of mechanotherapy may be implemented by means of an exercise machine, whose two embodiments are described below.

One of the embodiments of the inventive exercise machine is represented in FIGS. 1-6. The device comprises base 1 implemented, e.g. in the form of a buggy, couch, or lounger on wheels. On horizontal surface 2 of base 1 there is one of stationary supports 3-support 31 for the neck-and-head part attached to base 1. An extended (in direction L) lodgment for the patient's body consists of stationary elements 32 and 33, and movable elements 41, 42, 43 connected to drive 5 by means of power-transmitting elements 6.

Figure 2:
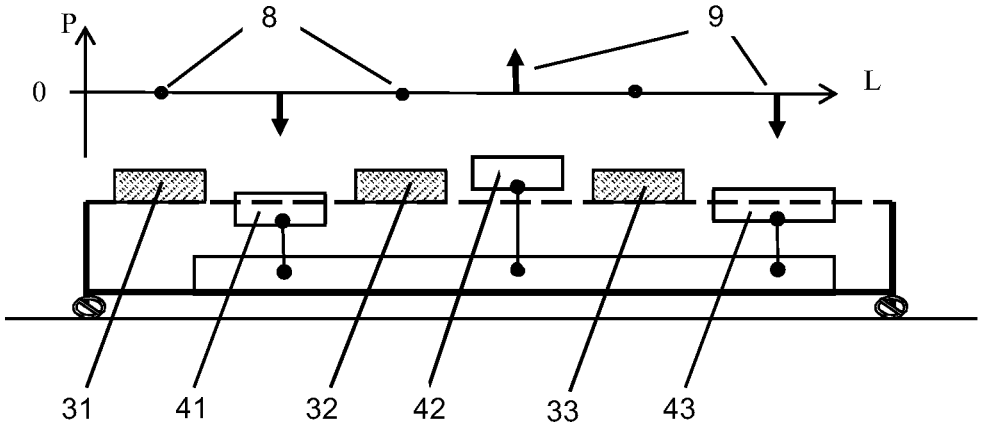
FIGS. 2, 3 illustrate side schematic views of the exercise machine presented in FIG. 1 showing the operating principle thereof.
Figure 3:
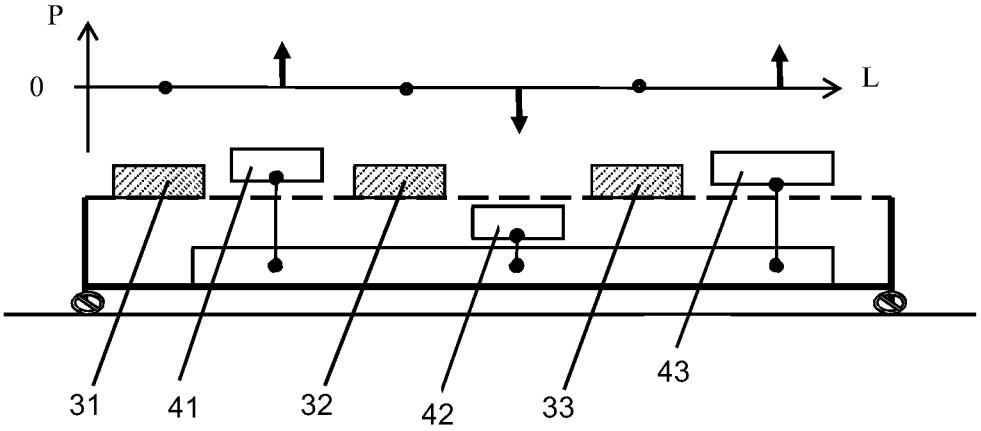
Figure 4:
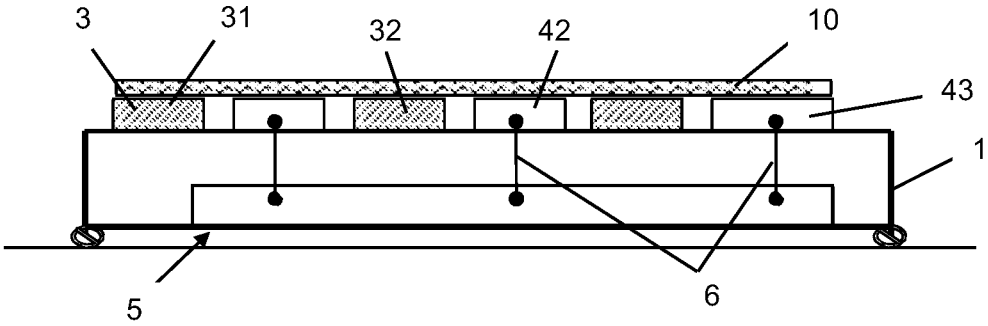
FIG. 4 illustrates a side schematic view of the lodgment of the exercise machine, according to an embodiment of the present invention.
Figure 5:
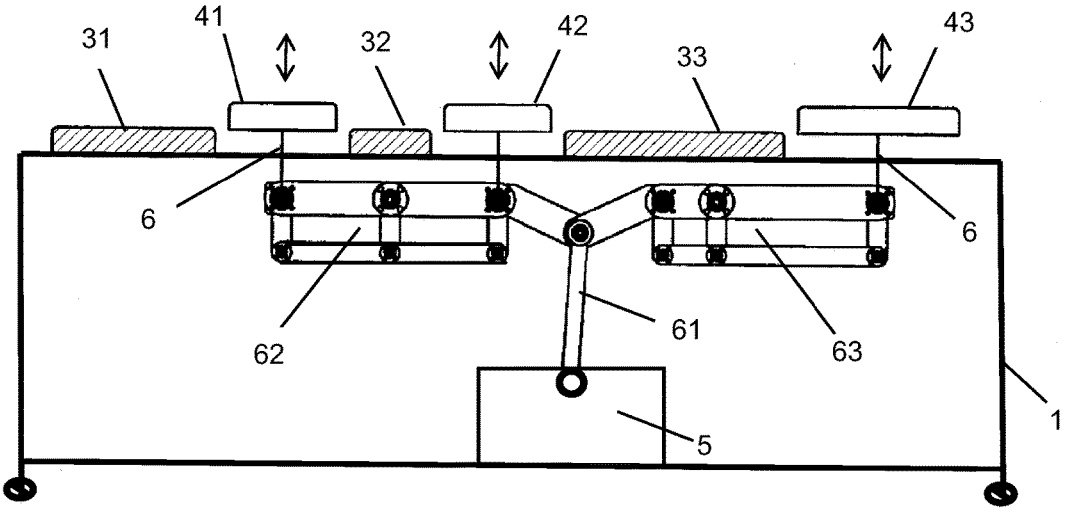
FIG. 5 illustrates a kinematic schema of a drive with a pantograph and the lodgment sections associated therewith, according to an embodiment of the present invention showing the operating principle thereof.
Figure 6A:
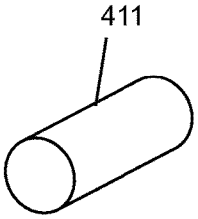
FIG. 6A illustrates a perspective view of the section 411 of the lodgment having a roll shape, according to an embodiment of the present invention.
Figure 6B:
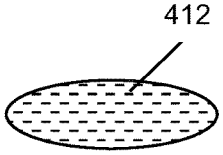
FIG. 6B illustrates a cross-sectional view of the section 412 of lodgment, according to an embodiment of the present invention.
Figure 6C:
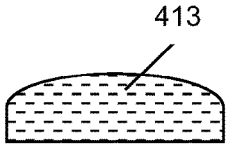
FIG. 6C illustrates a cross-sectional view of the section 413 of lodgment, according to an embodiment of the present invention.
Figure 6D:
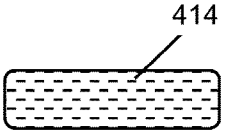
FIG. 6D illustrates a cross-sectional view of the section 414 of lodgment, according to an embodiment of the present invention.

The lodgment formed of stationary and movable elements provides anti-phase movements of its medium part (conventionally indicated as an element of ref. 42) relative to its peripheral parts (elements of ref. 41, 43) in the vertical plane. The diagrams of FIGS. 2, 3 show positions of stationary elements (points of ref. 8) and movable elements (arrows of ref. 9) in the course of functioning of drive 5 causing movement of movable elements in the vertical plane in direction P.

Element 41 is supposed to be intended for positioning of various sections of the upper body for affecting various sections of spine (with the person lying on his back, side, or abdomen). Element 32 is placed between movable elements 41 and 42, element 42 is for positioning of the pelvic section, element 33 is located between movable elements 42 and 43, element 43 is for positioning of sections of the lower limbs. Accordingly, the movable elements produce a passive force influence, while the stationary elements support the elements of body, though this purpose is largely conventional and takes no account of stretching of muscles and joints in the support areas. Here, the neck-and-head support provides for physiologically acceptable movements of the head in the course of the body movements.

The exercise machine may comprise means for preliminary positioning of the lodgment movable and stationary elements relative to each other in the horizontal plane, as well as that of a support for the neck-and-head section according to the patient's anatomy. In this description, these structural elements are not specified, as they are known from the state of art to any specialist (guides, pivots with latches, etc.) and are applied according to their known purpose. The external surface of the lodgment may have continuous cover 10 of an elastic material (see FIG. 4). The lodgment elements of the exercise machine may be exchangeable (see FIG. 6), and the dimensions and shape of their surface engaged in contact with the person's body may be both rounded, for concentration of the force influence in a specific area (ref. 411, 412, 413), e.g., in the form of a roller (ref. 411), and flat (ref. 414).

Drive 5 ensuring, by means of power-transmitting elements 6, movement of the lodgment elements may be selected from among the known ones, e.g., of the electromechanical type. In the simplest case, drive 5 may consist of an electric motor and an electromagnetic brake, complete with a worm gear. The mechanism of transmission of a reciprocal anti-phase motion to the elements may be implemented, e.g., as a sort of pantograph (see FIG. 5). To this effect, drive 5 is connected, through pusher 61, to mechanisms 62, 63 of the pantograph, its arms connected through relevant power-transmitting elements 6 to movable elements 41, 42, 43 in such a way that external elements (41 and 43) exercise anti-phase motion relative to element 42.

Another embodiment of the inventive exercise machine is presented in FIGS. 7-10. The device comprises base 1 implemented, e.g., in the form of a buggy, couch, or lounger on wheels. On base 1, there is stationary support 13-support 131 for the neck-and-head section attached to base 1. The lodgment is panel 110 elastic in the direction of its transversal axis (i.e., in the direction of an axis normal to the surface), its central part 141 is made rigid in width and connected to drive 5 by means of power-transmitting element 6. Stationary elements 132, 133 (their number, location relative to the lodgment longitudinal axis, dimensions, rigidity, damping devices and other structural elements selected experimentally, or from calculations, based on initial rigidity of panel 110, weight and height of a person positioned on the lodgment) are attached to base 1 and installed to allow bending oscillations of the panel, as well as possible damping and limitation of the aforesaid oscillations by amplitude. Above elements 132, 133 may be implemented in the form of hydraulic or pneumatic dampers or springs, which may be selected from among those known from the state of art, and their rigidity may, in particular, be adjusted depending on the patient's weight.

Figure 7A:
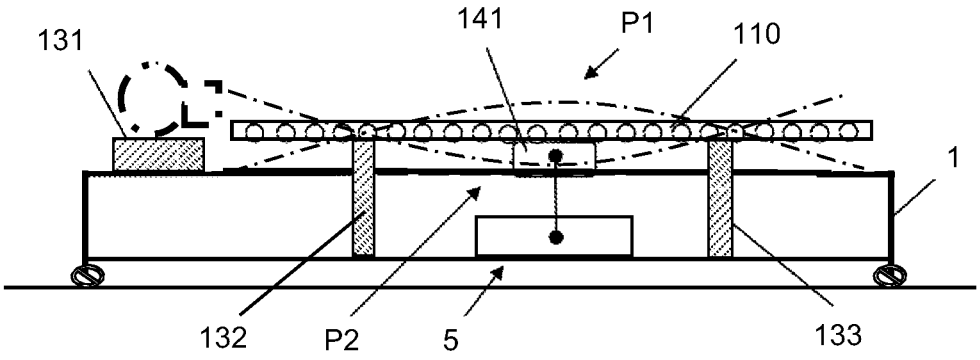
FIG. 7 illustrates a side schematic view of an embodiment of the exercise machine with a continuous flexible lodgment, according to an embodiment of the present invention.
Figure 7B:
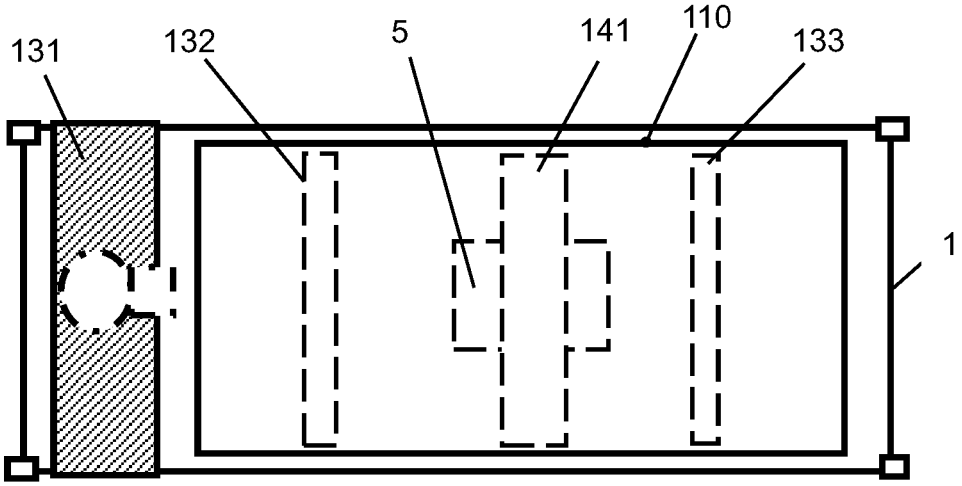
Figure 8:
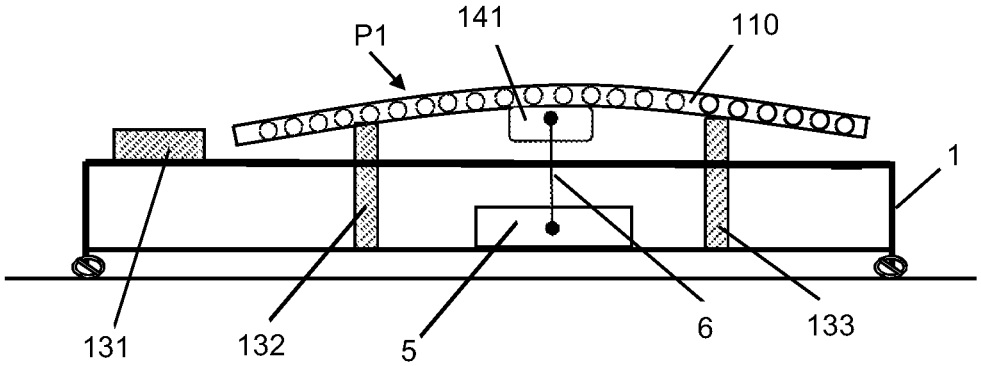
FIGS. 8, 9 depict a side schematic view of the exercise machine as of FIG. 7, according to an embodiment of the present invention, showing the operating principle thereof.
Figure 9:
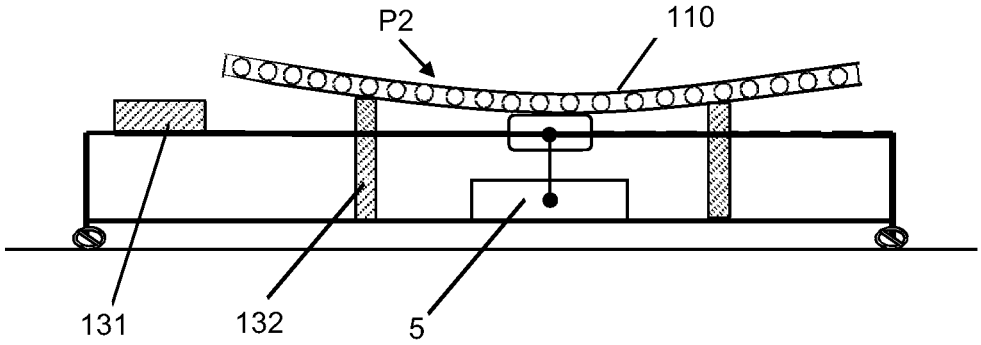
Figure 10:
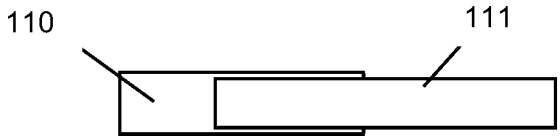
FIG. 10 illustrates a side schematic view of of the lodgment formed as a panel 110, according to the inventive embodiment shown on FIG. 7.

In FIG. 7, refs. P1 and P2 correspond to the type of oscillations with the drive in operation, and FIGS. 8,9 indicate the shape of the surface of panel in its extreme positions. Panel 110 may, in the directions of its longitudinal and transversal axes, feature means for adjustment of its length and width, respectively, e.g., of the type of pull-out console 111 locked in a set position with a latch (not shown).

Both of the embodiments of the exercise machine may comprise means for fixing and retaining the person's body, head, or specific parts on the lodgment. Such means in the form of belts, collars, jackets, hand-bands are known from the state of art, including applications for physiotherapy, and may be used for their known purpose (see, e.g., U.S. Pat. No. 6,821,288, Schaeffer, Nov. 23, 2004).

Drive 5, e.g., of the electromechanical type, is implemented to allow regulation of frequency, amplitude, parameters of reciprocal motion and duration of exposure cycles, where the drive may be controlled by both the patient and the operator, in particular, with computer technologies and individual health-improvement programs used, and also in automated mode. Drive 5 is also provided with means of remote control, a timer and a safety button.

The method is implemented as follows. The person is positioned lying on back, abdomen, or side on the lodgment (FIGS. 1, 7), the head placed on the support for the neck-and-head section; then, by moving the elements, the lodgment parts are fixed so that the part of body in question be above the corresponding element of the lodgment. Trial loading is performed. It is controlled for the neck-and-head section to be installed to allow natural movements of the head in the course of the upper body. Alternating loads are created by means of reciprocal movement of specific sections of the lodgment in the vertical direction in such a way that the upper body and the lower limbs make in-phase reciprocal movements, while the pelvic section make out-phase movements relative thereto. The frequency of reciprocal motion is 0.1-10 Hz, and the amplitude of reciprocal motion of the lodgment sections relative to the support for the neck-and-head section is 0.02-0.2 m for the upper body and pelvis, and 0.02-0.5 m for the lower limbs. Characteristics of drive 5 are selected in such a way that the reciprocal motion be exercised according to the law of harmonic variation of acceleration, yet impulse loading of the type of meander is also possible.

Here, alternating loading is exercised on the body parts set in motion owing to appearance of a force couple applied to the relevant joints at different sides in the opposite directions. As a result, stretching of the muscular fibers themselves is enhanced and accelerated owing to opposing longitudinal force vectors. This provides for bending movements of spine under a local influence of a section of the lodgment and the weight of body, as well as inertial movements in the knee and ankle joints under the influence of a section of the lodgment on the hip, or shin, respectively. E.g., in the course of movement of the upper body and legs upwards simultaneously with movement of the pelvis downwards, the relevant muscles are affected by longitudinal components of stretching forces in the opposing directions. The "spring" of receptors in the form of a "muscular spindle" is longitudinally stretched simultaneously at the ends in the opposite directions. The aforesaid becomes the key factor for creation of conditions for stimulation of neurotrophic reflexes to stretching of muscles and tendons, and constitutes a very important advantage. Movement of a part of the body upwards, along with a simultaneous movement of another part downwards, creates for the latter conditions of support relief, in addition to longitudinal weight relief, owing to the horizontal lying position. This is an important factor for additional relaxation of muscles in the course of their stretching.

Besides, in the case of a common mechanical drive ensuring anti-phase movements of the aforesaid supports (according to the type depicted in FIG. 5), as the body part under the support is moving downwards, along with the motor shaft, the load thereon decreases, which gives an economic advantage.

In the process of elaboration of the method modes, it has been established that it is expedient to exercise influence in cycles, each of which may comprise 10-14 sessions, from 2 . . . 3 to 5 . . . 7 a week. Here, in the course of the cycle, the frequency and amplitude of movements of the lodgment movable parts are increased from the minimum values to the physiologically optimum ones, or according to medical indications for each particular user.

Training sessions on exercise machines may be additionally combined with a creating a mindset aimed at health improvement, photo/phono stimulation and sound-and-light support. The frequency of photo/phono stimulation should be set in such a way that it would coincide with the frequency of exercising alternating influences on the person's skeletal muscles.

In the course of our own studies on the claimed method for the purpose of health improvement, we engaged 18 to 42 year old patients with signs of excessive body weight, excessive blood pressure of the vegeto-vascular genesis, spine ostheochondrosis. Here, all the patients were medically allowed to do therapeutic physical training, and their health deviations were unrelated to a pronounced organic pathological condition.

EXAMPLE

Under the claimed method of passive mechanotherapy on an exercise machine of the design shown in FIG. 1-6, there was performed treatment of a group of patients of 32, combined with creating, with some of them, of a mindset aimed at health improvement according to medical recommendations, as well as photo/phono stimulation and sound-and-light support.

18 patients of this group had an excessive body weight (on average; from 80 to 100 kg), while 12 of them also had excessive values of blood pressure (up to 140/90-150/100 mm Hg). The remaining 14 patients of this group, whose weight was within the normal range for their age, had manifestations of vegeto-vascular dysfunction of the hypertension type, on the average, up to 140/90 mm Hg. In the process of mechanotherapy, 18 patients with excessive weight produced a reliable ($p<0.05$) reduction of body weight and transversal body circumference as soon as after a two-week course of training. By the end of the four-week course, the above health recovery indicators improved considerably; at the same time, there were revealed statistically reliable adjustments of the initially higher than normal blood pressure with the aforesaid part of the patients.

In another group of 38 subjects, health improvement treatment was performed involving passive mechanotherapy on an exercise machine, its scheme shown in FIGS. 7-10. 24 persons of this group had an excessive weight (on the average, of 90 to 110 kg), while 8 of them also had higher than normal values of blood pressure (on the average, of 140/90 to 160/100 mm Hg). The remaining 14 patients of this group, whose weight was within the normal range for their age, had manifestations of vegeto-vascular dysfunction of the hypertension type, on the average, of 140/80 to 150/100 Hg.

In the process of application of mechanotherapy, the patients with excessive weight, similarly to the first group, produced a reliable ($p<0.05$) reduction of indicators under assessment as soon as after a 2-week course of training; at the same time, the degree of adjustments observed would rise with the course prolongation ($p<0.01$). Patients of this group with signs of higher than normal blood pressure, upon application of passive mechanotherapy, similarly to the first group, produced reliable adjustments of the relevant indicators. Owing to the same trends and statistical reliability of obtained health recovery indicators in the above groups, the results of survey of patients of those two groups were unified according to the principle of the same type of health disorders. Here, the unified group with excessive weight comprised 42 people, and for general assessment of the effect of mechanotherapy on the cardiovascular system indicators, the data of 48 patients were aggregated.

Figure 11:
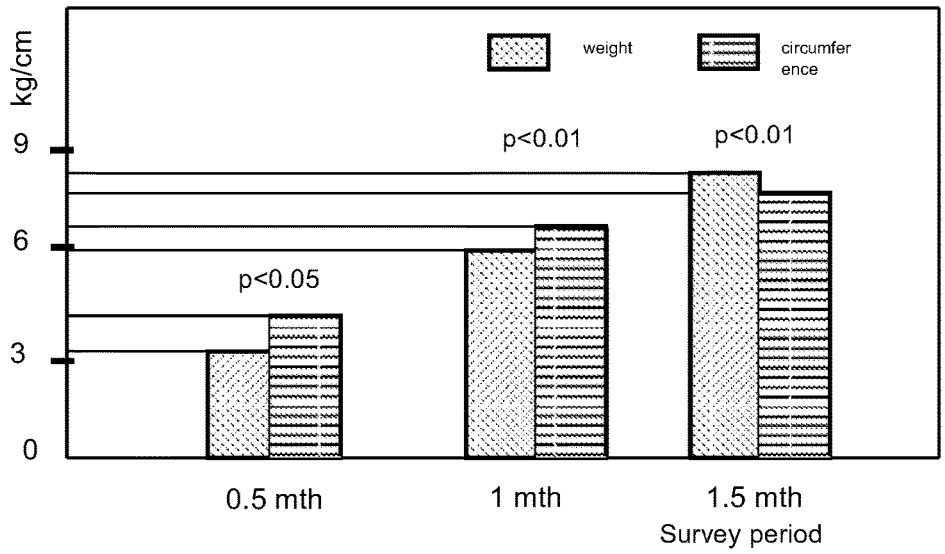
FIGS. 11, 12 present graphs illustrating dynamics of a person's body weight and blood pressure over periods of application of the claimed method of passive mechanotherapy.

FIG. 11 presents indicators of dynamics of body weight and circumference losses for the aforesaid 42 patients with excessive weight. It can be seen that the statistically reliable reduction of weight values was, on the average, 3.2 kg ($p<0.05$) as soon as 2 weeks after application of the above course, on the average, about 6 kg ($p<0.01$) after a month, and on the average up to 8.5 kg ($p<0.01$) after a month and a half. The dynamics of reduction of circumference values also demonstrated effects of health recovery weight loss and reached, in stages, more than 4 cm after half a month, about 7 cm after a month, and about 8 cm after a month and a half of treatment.

Figure 12:
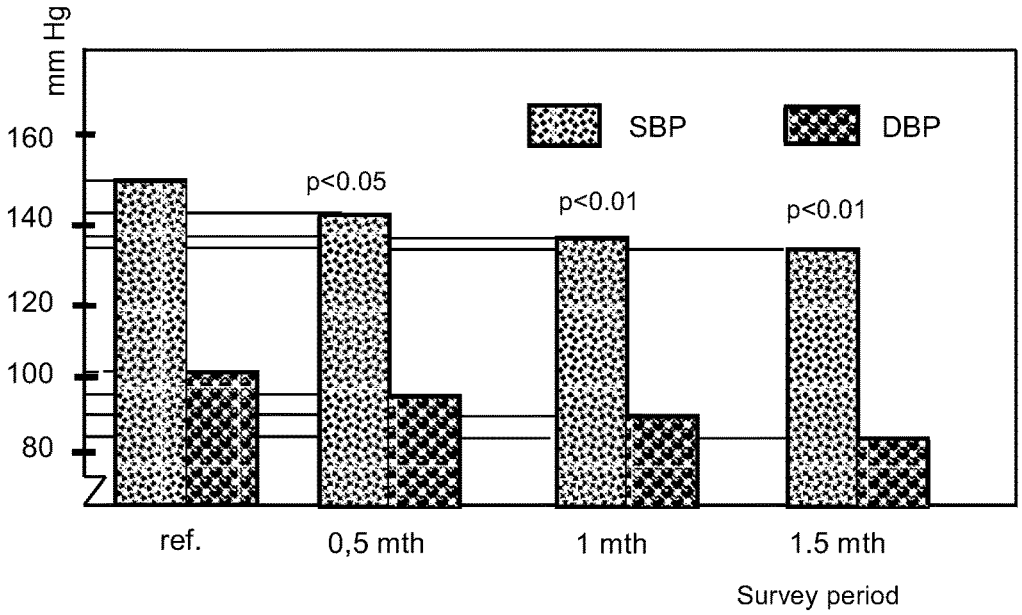

FIG. 12 presents the values of dynamics of systolic blood pressure (SBP) and diastolic blood pressure (DBP), with passive mechanotherapy, as based on results of a survey of 48 patients. It can be seen that the reliable blood pressure adjustments were, on the average, about 140/95 mm Hg as soon as after half a month of treatment (down from the average initial values for the group of about 150/100 mm Hg). By the end of a month-long course, the adjustments were, on the average, about 135/90 mm Hg, and a month and a half later they were, on the average, as low as 135-130/85 mm Hg, which is close to the physiologically normal values. At the same time, some of the patients with initial manifestations of functional tachycardia produced significant signs of adjustment of cardiac rhythm.

Patients of this group were also assessed for the spine conditions based on the indications of auxanometer and the maximum depth of bending in the frontal and sagittal planes: to the right-left and forwards-backwards from the standard position. There has been observed a reliable ($p<0.05$) improvement of the spine condition by the end of the complete treatment period: an increase of height with a considerable part of the patients, on the average, by up to 3-5 cm, as well as an increase of the bending depth by 10-20%, compared to the initial values.

It has to be noted that implementation of health-improving movements under conditions of weight and motional relief excludes the very possibility of a growth of blood pressure as a physiological reaction to the growing muscular tension. This factor is particularly significant in motion treatment of patients with initially higher than normal blood pressure levels, manifestations of spine ostheochondrosis, as well as those with excessive weight, as in the above cases physical tension may aggravate manifestation of their disorders. Application of physical load with the obese for a loss of weight is proved to be attended by elements of physiological stress.

Patients with the aforesaid manifestations of vegeto-vascular dysfunction including the psycho-emotional stress condition (12 patients) were subjected to well-known psychological tests, which enable to assess the reactive anxiety level (Spielberger-Hanin test). The results displayed a pronounced effect of arresting the emotional dysfunction, which is observed as a trend as soon as by the end of the second week of passive mechanotherapy, and becomes statistically reliable ($p<0.01$) as soon as a month after the beginning of treatment. This is reflected in improvement of indicators of the attention and memory function assessed by indicators of precision, speed and stability of performing computerized visual-motor alternative choice tasks.

The studies of brain bio-potentials performed on indications with this group of people before and after a month-long and longer course of treatment have revealed a considerable arresting of background effects of the alpha-rhythm desynchronization or hyper-synchronization. Here, there has been observed a statistically reliable ($p<0.05$) growth of stability indicators of the regulatory systems under assessment: the cardiovascular system (by reduced variation of cardiac rhythm in terms of its profile, time and restoration degree, under functional loads of cardiac rhythm and blood pressure), the emotional sphere (by reduction of anxiety level), and indicators of the functional status of brain.

The analysis performed confirms an assumption earlier suggested by the author, according to which one of the main natural mechanisms of adaptive health correction is restoration, to some extent, or another, of homeostatic components of cerebral neurodynamics under the effect of afferent flows initiated by cyclic locomotions. This, in its turn, produces a stimulating and stabilizing effect on processes of visceral-motor interactions, including the cardiovascular system, the emotional sphere and the mechanisms of regulation of lipometabolism and mineral metabolism.

In the course of therapeutic measures under the claimed method, there were observed, according to the patients' evidence, the following associated adjustments of the state of health: improvement of functioning of the gastrointestinal system, general well-being, reduction of emotional tension, anxiety, reduction or elimination of headaches, sleeping normalization, raising of the general and mental capacity.

For some of virtually healthy people (12 persons of 20 to 32 years of age), the claimed method of passive mechanotherapy was performed for the purposes of preventive, physical training and health recovery purposes. Subject to assessment were indicators of the static and dynamic endurance, as well as periods of their restoration, including application of carpal dynamometry, veloergometry, a number of known methods for assessment of precision characteristics of motor coordination. A month after the treatment, there were achieved statistically reliable ($p<0.05$) improvements of all the aforesaid indicators, which is an important argument in favor of application of the claimed exercise machines for the purposes of physical training and sports, as well.

INDUSTRIAL APPLICABILITY

The claimed inventions may be used for treatment of various forms of pathological conditions including: general asthenization, vegeto-vascular disfunction, deconditioning, disorders of mobility and flexibility in joints (ostheohondrosis, scoliosis, forms of arthritis, arthrosis, etc.), as well as with healthy persons affected by occupational or situational factors of stress, hypokinesia, or for preventive purposes. Application of the claimed inventions in physical training and sports contributes to training of elasticity of skeletal muscles and natural mobility of muscular-articular structures, which are known to play a significant role in physiological mechanisms of development of speed-strength, coordination and precision properties of the locomotor and neuromuscular systems, as well as acceleration of processes of restoration after physical loads, which may be used as a standalone or additional tool in the course of physical exercises.

What is claimed is:

1. An apparatus for performing mechanotherapeutic treatment of a patient, the apparatus comprising:

a rigid base;

an electromechanical drive attached to the base; and a lodgment adapted for supporting the patient in a recumbent position and having disposed in alternating order (i) stationary supports attached to the base and (ii) movable supports coupled to the drive, the lodgment consisting of the stationary supports and the movable supports; wherein the movable supports are adapted for rising above and lowering below the stationary supports, wherein the stationary supports include a first stationary support, a second stationary support, and a third stationary support, wherein the movable supports include a first movable support, a second movable support, and a third movable support, wherein the second movable support is positioned between the first movable support and the third movable support, wherein the first stationary support is positioned at a first end of the lodgment, the first movable support is positioned immediately adjacent to the first stationary support, the second stationary support is positioned immediately adjacent to the first movable support, the second movable support is positioned immediately adjacent to the second stationary support, the third stationary support is positioned immediately adjacent to the second movable support, and the third movable support is positioned immediately adjacent to the third stationary support and at a second end of the lodgment;

transversal widths of the stationary and movable supports are adapted to exceed a shoulder-to-shoulder width of the patient; and the drive is adapted for engaging the movable supports in in-phase/anti-phase reciprocating up-and-down movements performed with controlled frequencies and amplitudes, wherein the first and third movable supports are reciprocated in-phase and the second movable support is reciprocated in anti-phase with the first and third movable supports, and wherein the in-phase/anti-phase reciprocating up-and-down movement is adapted to reciprocally move a pelvic section of the patient in anti-phase with an upper section of a torso and lower limbs section of the patient.

2. The apparatus of claim 1, wherein (i) the frequencies are in a range 0.1-10 Hz and (ii) the amplitudes are in a range of 0.02-0.5 m.

3. The apparatus of claim 1, further having a means for adjusting positioning of the movable and stationary supports relative to each other.

4. The apparatus of claim 1, wherein the $1^{st}$ stationary support is adapted for supporting a head-and-neck region of the patient;

the $1^{st}$ movable support is adapted for rising/lowering an upper section of a torso of the patient;

the $2^{nd}$ stationary support is adapted for supporting a lower section of a torso of the patient;

the $2^{nd}$ movable support is adapted for rising/lowering a pelvic region of the patient;

the $3^{rd}$ stationary support is adapted for supporting upper sections of lower limbs of the patient; and the $3^{rd}$ movable support is adapted for rising/lowering lower sections of the lower limbs.

5. The apparatus of claim 1, wherein the lodgment comprises straps for affixing the patient to at least a portion of the stationary and movable supports.

6. A method of mechanotherapeutic treatment of a patient, the method comprising:

(a) placing the patient on an apparatus including:

a rigid base;

an electromechanical drive attached to the base; and a longitudinal lodgment adapted for supporting the patient in a recumbent position and having disposed in an alternating order stationary supports attached to the base and movable supports coupled to the drive, wherein transversal widths of the stationary and movable supports exceed a shoulder-to-shoulder width of the patient, the lodgment consisting of the stationary and movable supports;

(b) on the lodgment, positioning the patient on their back, abdomen or side providing that a body of the patient extends along the lodgment; and (c) for duration of a pre-selected time interval, using the drive for engaging the movable supports in in-phase/anti-phase reciprocating up-and-down movements with controlled frequencies and amplitudes, wherein the drive is adapted for reciprocating in-phase $1^{st}$ and $3^{rd}$ movable supports while reciprocating a $2^{nd}$ movable support in anti-phase relative to the $1^{st}$ and $3^{rd}$ movable supports; and (d) a $1^{st}$ stationary support is adapted for supporting a head-and-neck region of the patient in a fixed position with respect to the rigid base;

the $1^{st}$ movable support is immediately adjacent to the $1^{st}$ stationary support and is adapted for engaging an upper section of a torso of the patient;

a $2^{nd}$ stationary support is immediately adjacent to the $1^{st}$ movable support and is adapted for supporting a lower section of a torso, adjacent to a pelvic region of the patient;

the $2^{nd}$ movable support is immediately adjacent to the $2^{nd}$ stationary support and is adapted for engaging the pelvic region;

a $3^{rd}$ stationary support is immediately adjacent to the $2^{nd}$ movable support and is adapted for supporting upper sections of the lower limbs of the patient; and the $3^{rd}$ movable support is immediately adjacent to the $3^{rd}$ stationary support and is adapted for engaging lower sections of the lower limbs of the patient, wherein the $1^{st}$, $2^{nd}$, and $3^{rd}$ movable supports are selectively adapted for rising above and lowering below the $1^{st}$, $2^{nd}$, or $3^{rd}$ stationary supports, and wherein the in-phase/anti-phase reciprocating up-and-down movement is adapted to reciprocally move the pelvic region of the patient in anti-phase with the upper section of the torso and the lower limbs of the patient.

7. The method of claim 6, further comprising:

engaging the movable supports in the movements having (i) the frequencies in a range 0.1-10 Hz and (ii) the amplitudes in a range of 0.02-0.5 m.

8. The method of claim 6, further comprising:

providing straps for affixing the patient to the lodgment.

9. The method of claim 6, further comprising:

monitoring values of systolic blood pressure (SBP) and diastolic blood pressure (DBP) of the patient.

* * * * *